US007121042B2

(12) United States Patent
Robert et al.

(10) Patent No.: US 7,121,042 B2
(45) Date of Patent: Oct. 17, 2006

(54) DOOR ASSEMBLY FOR SEALING A CHAMBER

(75) Inventors: Maxime Robert, Quebec (CA); Louis Martineau, Quebec (CA)

(73) Assignee: STERIS Inc., Temecula, CA (US)

( * ) Notice: Subject to any disclaimer, the term of this patent is extended or adjusted under 35 U.S.C. 154(b) by 16 days.

(21) Appl. No.: 10/295,445

(22) Filed: Nov. 15, 2002

(65) Prior Publication Data

US 2004/0093801 A1 May 20, 2004

(51) Int. Cl.
*E05D 15/58* (2006.01)

(52) U.S. Cl. ..... 49/260; 49/209; 49/211; 49/218; 49/246

(58) Field of Classification Search ..... 49/216, 49/360, 209, 210, 211, 218, 219, 220, 246, 49/250, 260
See application file for complete search history.

(56) References Cited

U.S. PATENT DOCUMENTS 1,964,605 A * 6/1934 Tench ..... 414/323
2,587,863 A * 3/1952 Lambert ..... 114/120
3,554,144 A * 1/1971 Mescher ..... 110/177
3,802,125 A * 4/1974 Baker ..... 49/360
3,826,042 A * 7/1974 Daugirdas et al. ..... 49/213
4,000,582 A * 1/1977 Monot ..... 49/218
4,120,342 A * 10/1978 Mama et al. ..... 160/310
4,142,327 A * 3/1979 Griffith et al. ..... 49/215
4,178,857 A * 12/1979 Madland ..... 105/378
4,235,047 A * 11/1980 Turner ..... 49/371
4,359,176 A * 11/1982 Johnson ..... 105/240
4,361,985 A * 12/1982 DeMarco ..... 49/280
4,503,638 A * 3/1985 Schindehutte ..... 49/213
4,700,927 A * 10/1987 Henderson ..... 251/158
4,702,514 A * 10/1987 Perry ..... 296/146.9
4,726,709 A * 2/1988 Labelle ..... 405/103
4,756,123 A 7/1988 Roche et al. ..... 49/255
4,832,527 A * 5/1989 Bachmann ..... 405/105
4,964,228 A * 10/1990 Coffman ..... 34/242
5,140,770 A * 8/1992 Morvan ..... 49/215
5,142,823 A * 9/1992 Brandenburg et al. ..... 49/118
5,146,713 A 9/1992 Grafius ..... 49/255
5,191,993 A * 3/1993 Wanger et al. ..... 220/211
5,195,790 A 3/1993 Bulko et al. ..... 292/201
5,237,777 A 8/1993 Houston et al. ..... 49/360
5,239,781 A 8/1993 Napierkowski et al. ..... 49/501
5,249,392 A 10/1993 Houston et al. ..... 49/360
5,261,720 A * 11/1993 Lomax et al. ..... 296/146.9
5,387,063 A 2/1995 Napierkowski et al. ..... 410/67
5,391,360 A 2/1995 Kochte et al. ..... 422/292
5,438,800 A * 8/1995 Porter ..... 49/209
5,483,769 A * 1/1996 Zweili ..... 49/118
5,566,508 A 10/1996 Houston ..... 49/445
5,749,385 A 5/1998 Rochette et al. ..... 134/199
5,802,766 A * 9/1998 Miyazaki et al. ..... 49/29
5,829,949 A * 11/1998 Brown ..... 414/725
5,863,498 A 1/1999 Houston ..... 422/28

(Continued)

OTHER PUBLICATIONS

U.S. Appl. No. 09/498,811, filed Feb. 7, 2000, Sanford et al., entitled: Liquid Cleaning and Sterilizing System.

*Primary Examiner*—Jerry Redman
(74) *Attorney, Agent, or Firm*—Kusner & Jaffe; Michael A. Centanni

(57) ABSTRACT

A door assembly providing an airtight seal for a chamber. The door assembly includes a link assembly that allows a door to move inward toward a gasket sealing an opening into the chamber.

31 Claims, 5 Drawing Sheets

U.S. PATENT DOCUMENTS

| | | | | |
|---|---|---|---|---|
| 5,894,014 | A | 4/1999 | Houston et al. | 422/295 |
| 5,967,160 | A | 10/1999 | Rochette et al. | 134/200 |
| 6,017,105 | A | 1/2000 | Goughnour et al. | 312/209 |
| 6,135,130 | A | 10/2000 | Martineau | 134/113 |
| 6,264,901 | B1 | 7/2001 | Anderson | 422/295 |
| 6,319,479 | B1 | 11/2001 | Houston | 422/292 |
| 6,416,144 | B1 | 7/2002 | Houston et al. | 312/209 |
| 6,799,394 | B1 * | 10/2004 | Tsung-Lin | 49/209 |

* cited by examiner

DOOR ASSEMBLY FOR SEALING A CHAMBER

FIELD OF THE INVENTION

The present invention relates generally to closures for chambers, and more particularly to a door assembly for providing a fluid-tight seal around an opening to a chamber.

BACKGROUND OF THE INVENTION

In many applications, it is necessary to provide a fluid-tight seal around an opening to a chamber to prevent a medium (e.g., a gas or fluid) from escaping from the chamber, and visa versa, to prevent a medium outside the chamber from passing into the chamber.

In some applications, such as by way of example and not limitation, an industrial washer for washing medical instruments and equipment, a large sized door is required to seal a large access opening. Moreover, to allow for maximum access to the opening and a chamber therebeyond, the door must be capable of moving completely away from the opening.

The present invention is directed to a door assembly for providing a fluid-tight seal around an opening to a chamber, the door assembly being particularly well suited for sealing a large chamber having a large access opening.

SUMMARY OF THE INVENTION

In accordance with the present invention, there is provided a door assembly for sealing an opening having an associated seal, comprising: (a) a door; (b) at least two tracks defining a travel path for the door; (c) at least two guides respectively movable along the at least two tracks; (d) at least two pairs of links, wherein each link is connected to one of said guides at a first location, and connected to the door at a second location; and (e) means for moving said at least two guides along the at least two tracks, wherein the at least two pairs of links are movable between a first position wherein the door is spaced from the opening, and a second position wherein the door is pressed against the associated seal, to form a fluid-tight seal around the opening.

In accordance with still another aspect of the present invention, there is provided a door assembly for sealing an opening having an associated seal, comprising: (a) a door; (b) at least two frame members defining a first travel path of said door; (c) at least two door transport means operable to move said door along the first travel path, between a first position and a second position; and (d) at least two pair of links, each of said links connected to the door and connected to one of said door transport means, wherein said at least two pair of links are rotatable to move said door along a second travel path, between the second position and a seal engagement position, wherein the door engages the seal.

In accordance with yet another aspect of the present invention, there is provided a method of operating a door assembly having a door for sealing an opening, comprising the steps of: (a) moving a door along a first path from a first position to a second position, in a first direction relative to the opening; and (b) moving a door along a second path from second position to a sealing position in a second direction relative to the opening, wherein said door is spaced from the opening along the first path, and forms a fluid-tight seal around the opening in the sealing position.

An advantage of the present invention is the provision of a door assembly that provides an improved seal around an opening to a chamber.

Another advantage of the present invention is the provision of a door assembly providing a sliding door that is movable in a direction toward a door opening to effect a seal.

Still another advantage of the present invention is the provision of a door assembly providing an airtight seal on a chamber having a large access opening.

Still another advantage of the present invention is the provision of a door assembly that allows for maximum access to a chamber opening.

Yet another advantage of the present invention is the provision of a door assembly suitable for use with a sterilization washing chamber for sterilizing objects.

These and other advantages will become apparent from the following description of a preferred embodiment taken together with the accompanying drawings and the appended claims.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DETAILED DESCRIPTION OF A PREFERRED EMBODIMENT

Figure 1:
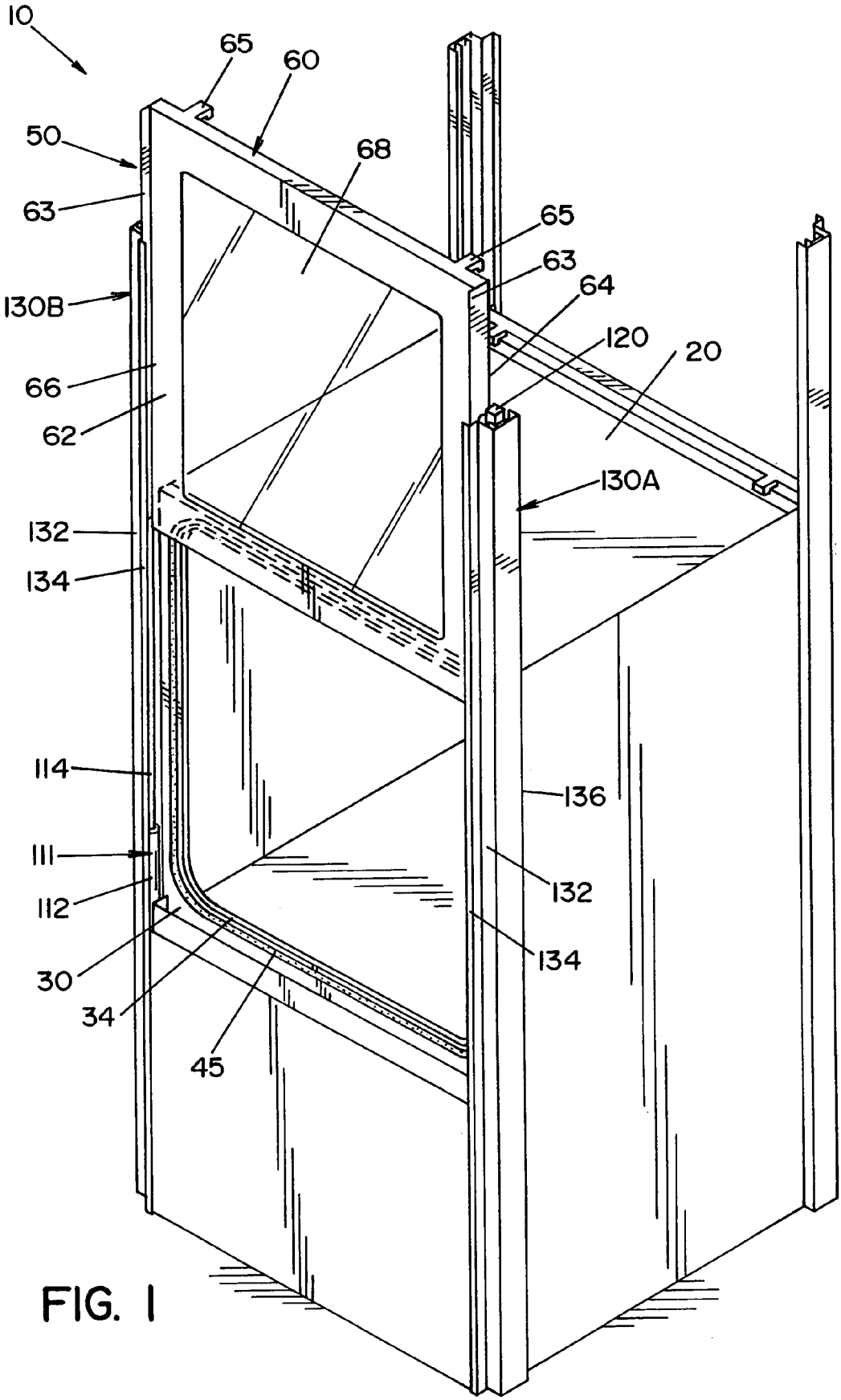
FIG. 1 is a perspective view of a door assembly for use on a washer sterilizer, according to a preferred embodiment of the present invention.

Referring now to the drawings wherein the showings are for the purpose of illustrating a preferred embodiment of the invention only, and not for the purpose of limiting same, FIG. 1 shows a door assembly 50 for use with a washer 10 of a type disclosed in U.S. Pat. No. 5,749,385 to Rochette et al., the disclosure of which is expressly incorporated herein by reference. Washer 10 is typically used for washing instruments and equipment, such as surgical, medical, dental, veterinary and mortuary instruments and equipment that contain, or potentially contain, biological contaminants. Door assembly 50 shall be described with reference to such washer 10. However, it is to be appreciated that the present invention may find advantageous application in sealing openings in other types of devices.

Figure 3:
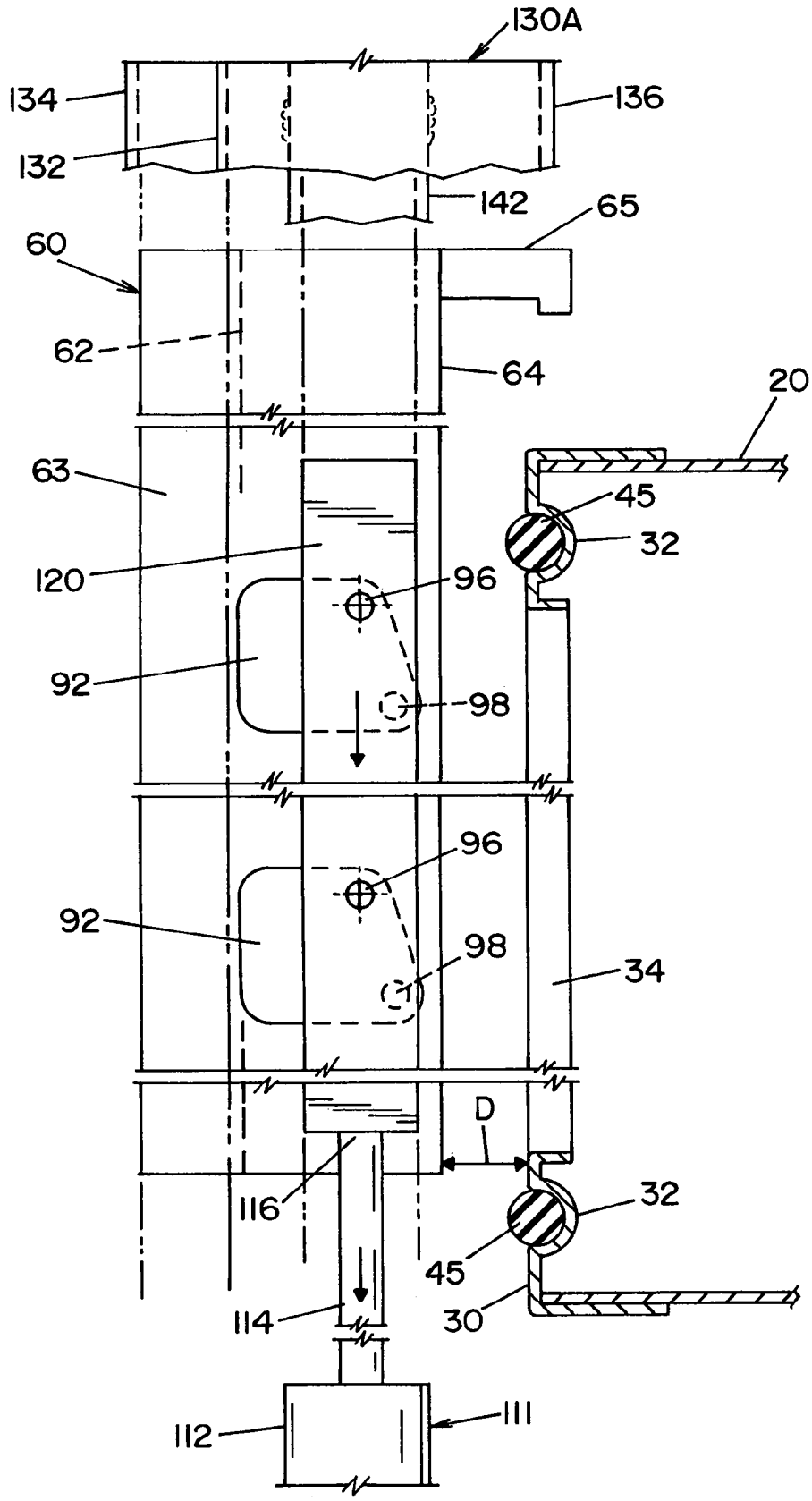
FIG. 3 is a partially sectioned, elevational view of the door assembly, showing the door assembly in an open door position.

FIG. 1 is a perspective view of washer 10, wherein portions of washer 10 have been omitted to facilitate description of door assembly 50. Washer 10 typically includes a washing chamber 20 that is generally rectangular in shape and that includes a front panel 30. Front panel 30 defines an access opening 34 to washing chamber 20. A channel or groove 32 is formed in front panel 30 around the periphery of opening 34, as best seen in FIG. 3. Channel or groove 32 is dimensioned to receive a conventional seal or gasket 45. It will be appreciated that the geometry of front panel 30 shown in FIGS. 1 and 3 is exemplary, and that the present invention is suitable for use with structures having geometries different than those shown in the drawings.

Door assembly 50 is generally comprised of a door 60 that is disposed between, and movable along, a path defined by two, spaced-apart door frame members 130A, 130B. A door transport mechanism 110 is operable to move door 60 along the path defined by door frame members 130A, 130B. Door 60 is movable between an open position (shown in FIG. 1) and a closed position (best illustrated in FIG. 4). In the embodiment shown, door 60 is generally movable in a vertical direction between the open and the closed positions.

Figure 2:
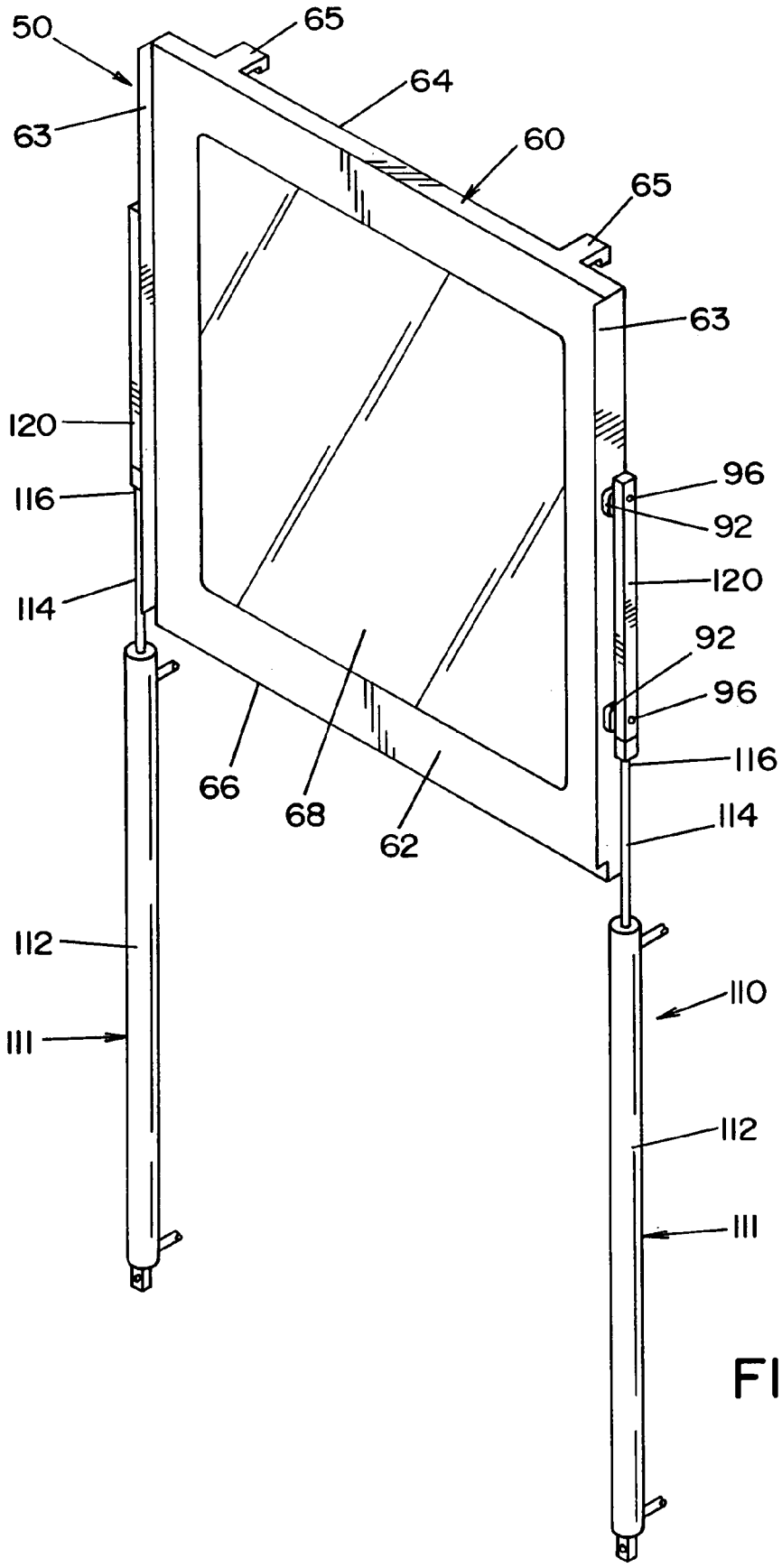
FIG. 2 is a perspective view of a portion of the door assembly of FIG. 1.
Figure 5:
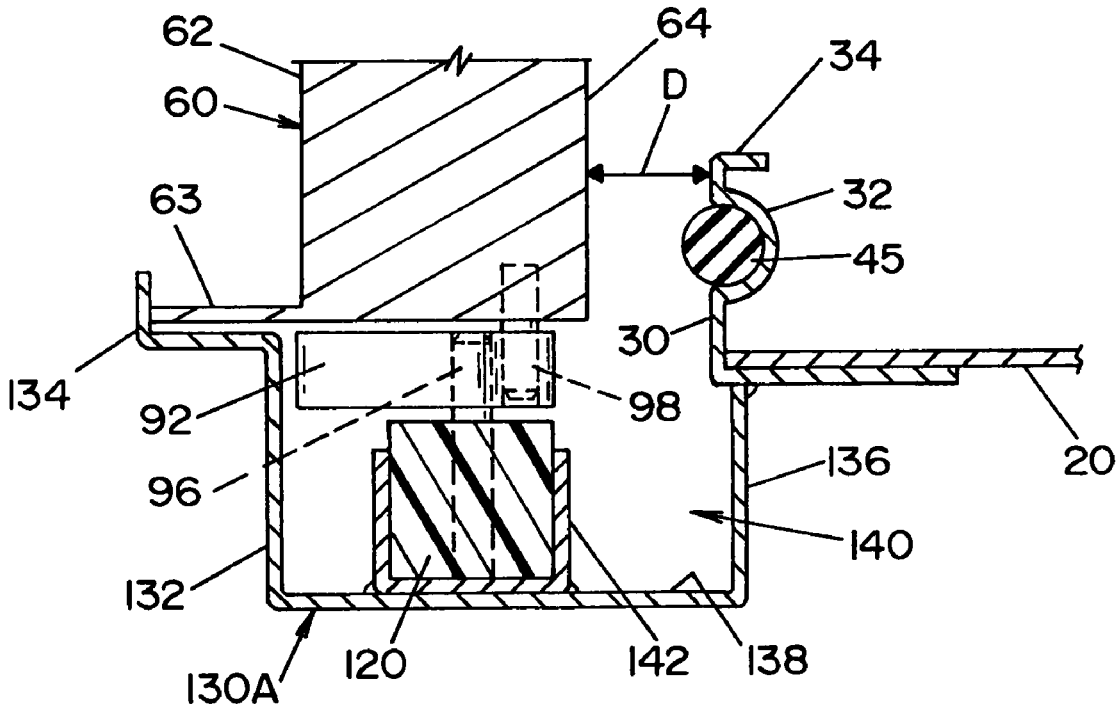
FIG. 5 is a cross-sectional, top view of one edge of the door assembly and washing chamber, showing the door assembly in an open door position.
Figure 6:
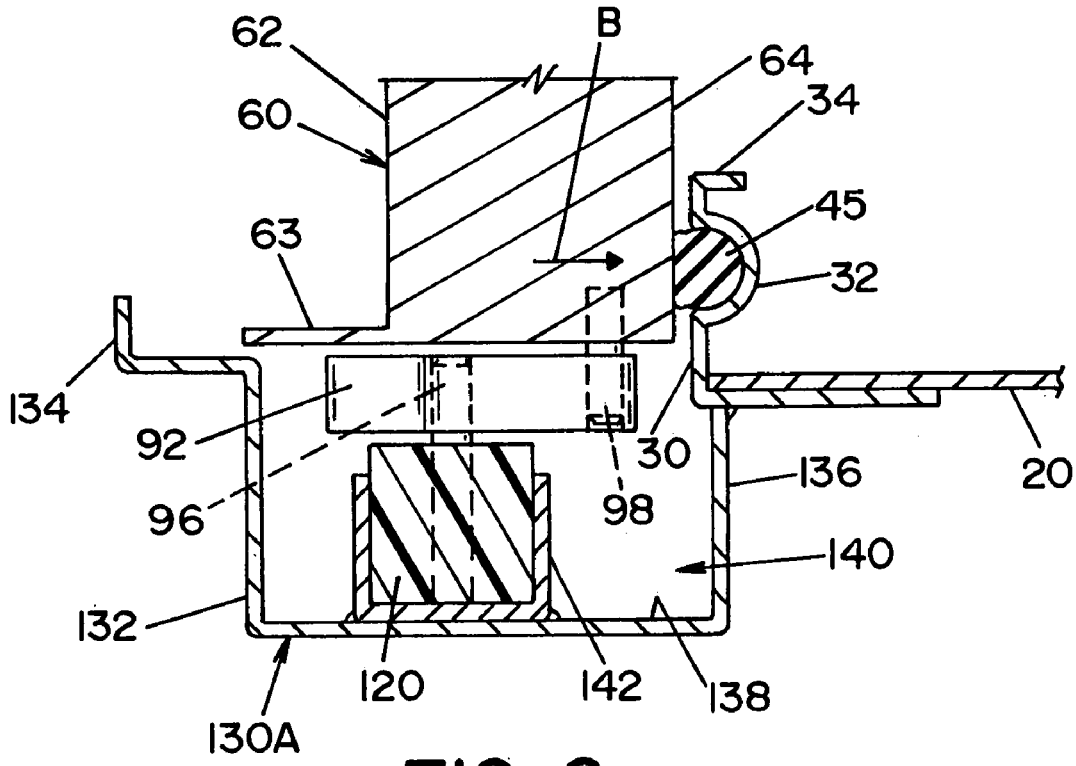
FIG. 6 is a cross-sectional, top view of one edge of the door assembly and washing chamber, showing the door assembly in a closed door position.

Door 60 is generally a flat, planar member. In the embodiment shown, door 60 is generally rectangular in shape, and has an outer metal frame 66 having a window 68 in the center thereof. Window 68 is attached to outer metal frame 66 by conventional means, to form a fluid seal therebetween. Window 68 allows an operator to view inside washing chamber 20. Metal frame 66 has opposite-facing generally planar surfaces 62, 64. Surface 64 faces inwardly toward washing chamber 20. Surface 62, on the opposite side of door 60, faces outwardly, away from washing chamber 20. A flange 63, best seen in FIGS. 5 and 6, is formed along the lateral edges of outer metal frame 66, and extends outwardly from surface 62. The upper edge of door 60 includes a pair of spaced-apart stop members 65 that extend outwardly, away from surface 64 toward washing chamber 20, as shown in FIGS. 2 and 3.

Referring now to FIGS. 5 and 6, a cross-section of door frame member 130A is best seen. Door frame member 130B is basically a mirror image of door frame member 130A, and accordingly, only door frame member 130A shall be described in detail, it being understood that the description applies equally to door frame member 130B. Door frame member 130A is basically an elongated member formed to have a generally U-shaped cross-section, as shown in FIGS. 5 and 6. Door frame member 130A has two, spaced-apart wall sections 132, 136 that are generally parallel to each other. Wall section 132 is formed to include a generally L-shaped extension 134. Wall section 136 of door frame member 130A is dimensioned for attachment to washer 10. In the embodiment shown, wall section 136 is secured to front panel 30 of washing chamber 20, as best seen in FIGS. 5 and 6. Door frame member 130A defines an inner rectangular cavity 140. A generally U-shaped track 142 is disposed within cavity 140. U-shaped track 142 is attached to inner surface 138 of door frame member 130A, and extends along a portion of door frame member 130A, namely the upper portion thereof. Both door frame member 130A and U-shaped track 142 are formed of metal. In the embodiment shown, U-shaped track 142 is welded or soldered to door frame member 130A.

Referring now to FIG. 1, a door transport mechanism 110 is shown disposed within cavity 140 defined by door frame member 130A. It should be appreciated that a like door transport mechanism 110 is disposed within cavity 140 defined by door frame member 130B. In the embodiment shown, door transport mechanism 110 is comprised of a cylinder 111 having a cylinder body 112 and an elongated rod 114, as best seen in FIG. 2. Cylinder 111 may be a pneumatic cylinder or a hydraulic cylinder. Elongated rod 114 is reciprocally movable between an extended position and a retracted position. Cylinder body 112 is dimensioned to be disposed within cavity 140 defined by door frame member 130A, at the lower end thereof. In this respect, as indicated above, track 142 does not extend into the lower portion of door frame member 130A where cylinder body 112 is positioned.

An elongated, generally rectangular guide 120 is attached to end 116 of rod 114. Guide 120 is dimensioned to be received within track 142, and to be movable therealong (see FIG. 6). In a preferred embodiment, guide 120 is formed of plastic. Guide 120 is connected to door 60 by two, spaced-apart links 92. Each link 92 is connected to guide 120 by a pin 96 (see FIG. 3). Links 92 are pinned to guide 120 for pivotal motion relative thereto and are pinned to guide 120 at a first location wherein pin 96 is in axial alignment with the axis of rod 114, as best seen in FIG. 3. Links 92 are pinned to door 60 by pins 98 (shown in phantom in FIGS. 3 and 4) at a second location offset from pins 96, as best seen in FIG. 3. Flange 63 on door 60 abuts L-shaped extension 134 on the door frame member 130A, to prevent outward movement of door 60 from opening 34 beyond the position illustrated in FIG. 5.

It should be appreciated that a control unit (not shown) is provided to control operation of door transport mechanism 110. In this regard, the control unit is operable to activate operation of cylinder 111 so as to extend or retract rod 114.

Operation of door assembly 50 will now be described in detail. Door 60 is movable between a first door open position, seen in FIG. 1, wherein door 60 is removed from opening 34 and a second door closed position, wherein surface 64 of door frame 66 is pressed against seal 45 to form a fluid-tight, i.e., an air tight and liquid tight, seal around opening 34.

In its first door open position, cylinder rods 114 are extended from cylinder body 112. Door 60 is spaced at a predetermined distance "D" from the surface of front panel 30, as seen in FIGS. 3 and 5. The weight of door 60, supported by cylinder rods 114, effectively maintains the distance of space "D" between door 60 and front panel 30. In this respect, the weight of door 60 would normally cause it to move to a position, wherein pins 98 are directly below and aligned with pins 96. However, flange 63 abutting L-shaped extension 134 (see FIG. 5) maintains door 60 in the position shown in FIG. 3, and prevents further movement of door 60 from front panel 30.

When cylinders 111 within door frame members 130A, 130B are activated to retract rods 114 into cylinder bodies 112, guides 120 are pulled downward along tracks 142. As guides 120 moves downward along tracks 142, door 60, which is supported by guides 120, will also move vertically downward along a first vertical path. Links 92 will remain in a first position (see FIG. 3) as door 60 moves vertically downward in response to retraction of rod 114. Spacing "D" will be maintained between surface 64 of door 60 and front panel 30 of washing chamber 20, as door 60 moves vertically downward.

Eventually, door 60 reaches a position wherein stop members 65 on the upper edge of door 60 engage the upper surface of front panel 30 of washing chamber 20 (see FIG. 4), impeding any further downward vertical movement of door 60 along the first path. However, rods 114 will continue to retract after engagement of stop members 65, causing guides 120 to move farther downward through tracks 142. As a result, links 92 are caused to rotate in the direction of arrows A from a first position (shown in FIG. 3) to a second position (shown in FIG. 4). As links 92 rotate, door 60 is forced to move in a horizontal direction, toward front panel 30, in the direction of arrow B. Surface 64 of door 60 is forced into engagement with seal 45. In this regard, surface 64 of door 60 compresses seal 45 to form a fluid-tight seal around opening 34, thus sealing washing chamber 20. Preferably, cylinders 111 are operable to maintain a downward force on rod 114 to maintain door 60 in the closed position.

Figure 4:
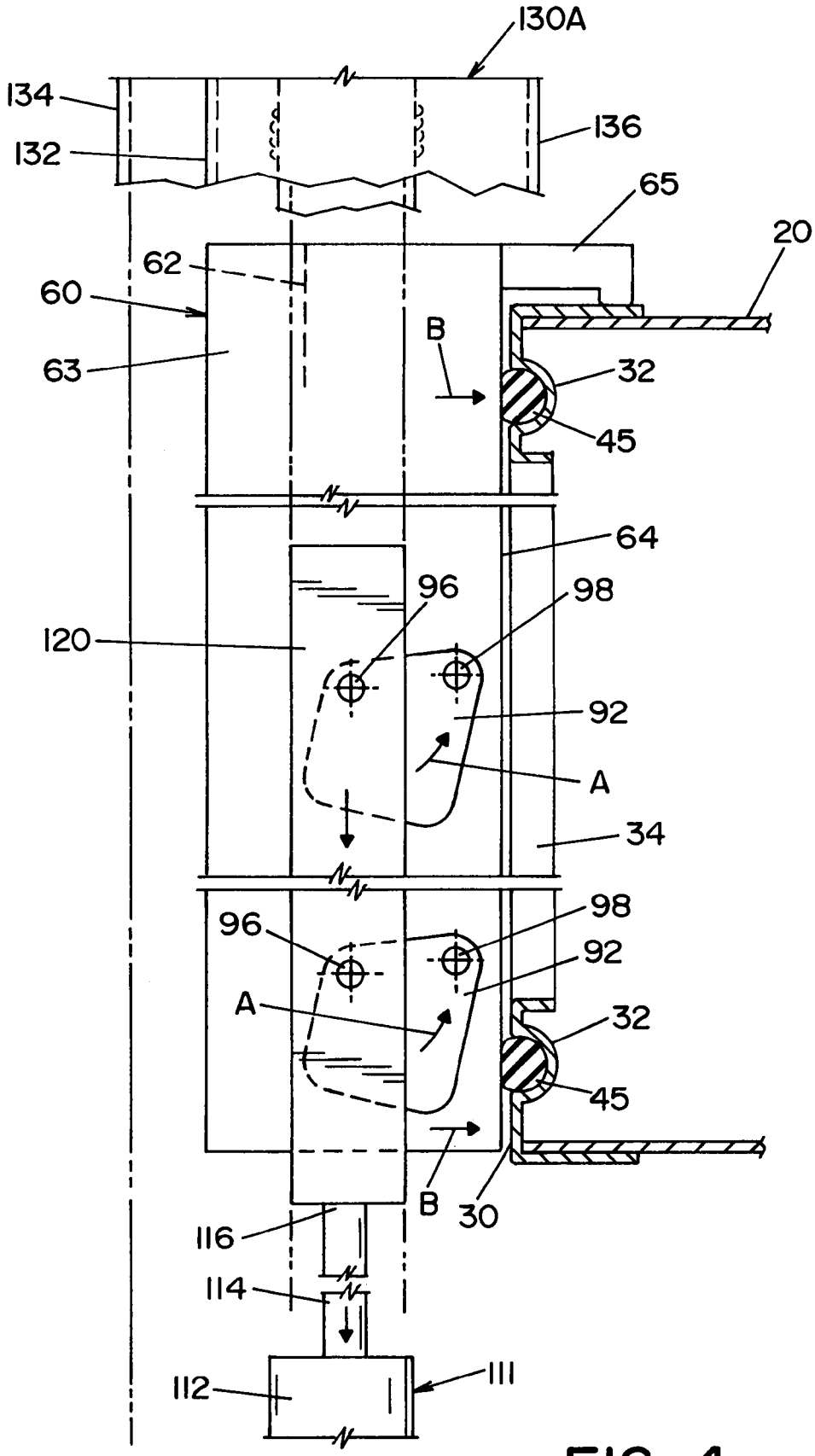
FIG. 4 is a partially sectioned, elevational view of the door assembly, showing the door assembly in a closed door position.

It should be appreciated that links 92 are rotated to an "overcenter" position wherein pins 96 are located at a position below pins 98, as seen in FIG. 4. This overcenter positioning of pins 96 relative to pins 98, and the engagement of stop 65 against front panel 30 effectively produces a "vise grip type" locking arrangement to maintain the seal in the event power is lost to cylinders 111. In this regard, the overcenter locking arrangement prevents rotation of links 92 in a direction that would cause door 60 to move away from sealing engagement with front panel 30.

With regard to a door opening operation, cylinders 111 are activated to extend rods 114 out from cylinder bodies 112. Accordingly, guides 120 will move in an upward vertical direction through tracks 142. The initial movement of guides 120 causes links 92 to rotate in a direction opposite of arrows A. As links 92 rotate, door 60 will move away from front panel 30 of washing chamber 20 (opposite the direction of arrow B). Accordingly, surface 64 of door 60 will disengage from seal 45, thus breaking the seal with washing chamber 20.

Door 60 will move away from front panel 30 until flanges 63 of door 60 abut L-shaped extensions 134 on door frame members 130A, 130B. Continued upward movement of guides 120 causes door 60 to move upwardly. When rods 114 have reached predetermined, fully extended positions, movement of door 60 will stop, with door 60 being in its first, open position.

In summary, door 60 is movable along a first path defined by spaced-apart door frame members 130A, 130B, between a first position and a second position. Door 60 is also movable along a second path, between the second position and a seal engagement position. In the embodiment shown, the first path is transverse to the second path, wherein the first path is a generally vertical direction, and the second path is a generally horizontal direction. Door 60 moves to a closed position as rods 114 retract, and moves to an open position as rods 114 extend. Furthermore, rotation of links 92 moves door 60 between the second position and the seal engagement position.

Other modifications and alterations will occur to others upon their reading and understanding of the specification. It is intended that all such modifications and alterations be included insofar as they come within the scope of the invention as claimed or the equivalents thereof.

Having described the invention, the following is claimed:

1. A door assembly for sealing an opening surrounded by a seal member, said door assembly comprising:

at least two tracks defining a linear travel path;

a door movable along the linear travel path, said door having at least one stop member extending therefrom and fixed relative to said door, the at least one stop member preventing further movement of the door along the linear travel path;

at least two guides respectively movable along the at least two tracks;

at least two pairs of links, each link connected to one of said guides at a first location, and connected to the door at a second location, wherein the at least two pairs of links are movable between a first position where the door is spaced from the opening, and a second position where the door is adapted to press against the seal member surrounding the opening, to form a fluid-tight seal around the opening; and means for moving said at least two guides along the at least two tracks, wherein said door is movable in a direction transverse to said linear travel path after said at least one stop member impedes movement of said door along said linear travel path, wherein said means for moving said at least two guides continues to move said at least two guides along said linear path after movement of said door along said linear path is prevented by said stop member, thereby causing said at least two pairs of links to move said door from said first position to said second position.

2. A door assembly as defined by claim 1, wherein said means for moving said at least two guides includes:

a cylinder body; and a rod, said rod movable between a retracted position and an extended position.

3. A door assembly as defined by claim 1, wherein each of said links is connected to one of said guides by a first pin, and each of said links is connected to said door by a second pin.

4. A door assembly as defined by claim 1, wherein said links rotate between said first position and said second position.

5. A door assembly for sealing an opening surrounded by a seal member, said door assembly comprising:

at least two frame members defining a first travel path;

a door movable along the first travel path;

at least one stop member extending from the door and fixed relative to said door, the at least one stop member preventing further movement of the door along the first travel path;

at least two door transport means operable to move said door along the first travel path, between a first position and a second position; and at least two pair of links, each of said links connected to the door and connected to one of said door transport means, wherein said at least two pair of links are rotatable to move said door along a second travel path transverse to said first travel path, after said at least one stop member prevents movement of the door along the first travel path, said second travel path defined between the second position and a seal engagement position, where the door is adapted to engage the seal member surrounding the opening, wherein said at least two door transport means continue to move after movement of said door along the first travel path has been prevented by said stop member, thereby causing said at least two pair of links to move said door along said second travel path.

6. A door assembly as defined by claim 5, wherein each said door transport means includes a cylinder having a cylinder body, and an extendable rod having a guide mounted thereto, said guide connected to one of said links.

7. A door assembly as defined by claim 6, wherein each said rod is movable between an extended position and a retracted position.

8. A door assembly as defined by claim 5, wherein said at least two pair of links commence rotation in a first rotation direction upon engagement of said stop member, to move said door along the second travel path, from the second position to the seal engagement position.

9. A door assemlAy as defined by claim 8, wherein said at least two pair of links are in an overcenter position when said door is in the seal engagement position.

10. A door assembly as defined by daim 8, wherein said door moves from the seal engagement position to the second position, upon rotation of said at least two pair of links in a direction reverse to said first rotation direction.

11. A door assembly for sealing an opening surrounded by a seal member, said door assembly comprising:

at least two tracks defining a linear travel path;

a door movable along the linear travd path and induding a stop member extending therefrom and fixed relative to said door, said stop member preventing frirther movement of said door along the linear travel path;

a door transport means for moving said door along the linear travel path;

at least one linking member connected to the door at a first pivot location and connected to the door transport means at a second pivot location, said second pivot location restricted to said linear travel path, and said first pivot location movable to move said door along a travel path transverse to the linear travel path toward the seal member when further movement of said door is prevented along said linear travel path by the stop member, wherein said door transport means continues to move said second pivot location along said linear path after movement of said door along said linear path is prevented by said stop membew said door transport means thereby causing said at least one linking member to move said door along said travel path transverse to the linear travel path toward said seal member.

12. A door assembly as defined by claim 11, wherein said door transport means includes a cylinder having a cylinder body, and an extendable rod having a guide mounted thereto, said guide connected to one of said linking members.

13. A door assembly as defined by claim 12, wherein each said rod is movable between an extended position and a retracted position.

14. A door assembly as defined by claim 11, wherein said at least one linking member is in an overeenter position when said door engages with said seal member surrounding the opening.

15. A door assembly in combination with a chamber having an upper surface, said door assembly sealing an opening of the chamber, wherein said opening is surrounded by a seal member, said door assembly comprising:

at least two tracks defining a linear travel path;

a door movable along the linear travel path, said door having at least one stop member extending therefrom and fixed relative to said door, the at least one stop member engageable with the upper surface of the chamber to prevent further movement of the door along the linear travel path;

at least two guides respectively movable along the at least two tracks;

at least two pairs of links, each link connected to one of said guides at a first location, and connected to the door at a second location, wherein the at least two pairs of links are movable between a first position where the door is spaced from the opening, and a second position where the door is adapted to press against the seal member surrounding the opening, to form a fluid-tight seal around the opening; and means for moving said at least two guides along the at least two tracks, wherein said door is movable in a direction transverse to said linear travel path after said at least one stop member impedes movement of said door along said linear travel path.

16. A door assembly as defined by claim 15, wherein said means for moving said at least two guides includes:

a cylinder body; and a rod, said rod movable between a retracted position and an extended position.

17. A door assembly as defined by claim 15, wherein each of said links is connected to one of said guides by a first pin, and each of said links is connected to said door by a second pin.

18. A door assembly as defined by claim 15, wherein said links rotate between said first position and said second position.

19. A door assembly as defined by claim 15, wherein said means for moving said at least two guides continues to move said at least two guides along said linear path after movement of said door along said linear path is prevented by said stop member, thereby causing said at least two pairs of links to move said door from said first position to said second position.

20. A door assembly in combination with a chamber having an upper surface, said door assembly sealing an opening of the chamber, wherein said opening is surrounded by a seal member, said door assembly comprising:

at least two frame members defining a first travel path;

a door movable along the first travel path;

at least one stop member extending from the door and fixed relative to said door, the at least one stop member engageable with the upper surface of the chamber to prevent further movement of the door along the first travel path;

at least two door transport means operable to move said door along the first travel path, between a first position and a second position; and at least two pair of links, each of said links connected to the door and connected to one of said door transport means, wherein said at least two pair of links are rotatable to move said door along a second travel path transverse to said first travel path, after said at least one stop member prevents movement of the door along the first travel path, said second travel path defined between the second position and a seal engagement position, where the door is adapted to engage the seal member surrounding the opening.

21. A door assembly as defined by claim 20, wherein each said door transport means includes a cylinder having a cylinder body, and an extendable rod having a guide mounted thereto, said guide connected to one of said links.

22. A door assembly as defined by claim 21, wherein each said rod is movable between an extended position and a retracted position.

23. A door assembly as defined by claim 20, wherein said at least two pair of links commence rotation in a first rotation direction upon engagement of said stop member, to move said door along the second travel path, from the second position to the seal engagement position.

24. A door assembly as defined by claim 23, wherein said at least two pair of links are in an overcenter position when said door is in the seal engagement position.

25. A door assembly as defined by claim 23, wherein said door moves from the seal engagement position to the second position, upon rotation of said at least two pair of links in a direction reverse to said first rotation direction.

26. A door assembly as defined by claim 20, wherein said at least two door transport means continue to move after movement of said door along the first travel path has been prevented by said stop member, thereby causing said at least two pair of links to move said door along said second travel path.

27. A door assembly in combination with a chamber having an upper surface, said door assembly sealing an opening of the chamber, wherein said opening is surrounded by a seal member, said door assembly comprising:

at least two tracks defining a linear travel path;

a door movable along the linear travel path and including a stop member extending therefrom and fixed relative to said door, said stop member engageable with the upper surface of the chamber to prevent further movement of said door along the linear travel path;

a door transport means for moving said door along the linear travel path;

at least one linking member connected to the door at a first pivot location and connected to the door transport means at a second pivot location, said second pivot location restricted to said linear travel path, and said first pivot location movable to move said door along a travel path transverse to the linear travel path toward the seal member when further movement of said door is prevented along said linear travel path by the stop member.

28. A door assembly as defined by claim 27, wherein said door transport means includes a cylinder having a cylinder body, and an extendable rod having a guide mounted thereto, said guide connected to one of said linking members.

29. A door assembly as defined by claim 28, wherein each said rod is movable between an extended position and a retracted position.

30. A door assembly as defined by claim 27, wherein said at least one linking member is in an overcenter position when said door engages with said seal member surrounding the opening.

31. A door assembly as defined by claim 27, wherein said door transport means continues to move said second pivot location along said linear path after movement of said door along said linear path is prevented by said stop member, said door transport means thereby causing said at least one linking member to move said door along said travel path transverse to the linear travel path toward said seal member.

* * * * *